United States Patent [19]

Lucero

[11] 4,021,043

[45] * May 3, 1977

[54] METHOD PROVIDING CHESS APPARATUS

[76] Inventor: Ronald Ray Lucero, P.O. Box 630, Nyack, N.Y. 10960

[ * ] Notice: The portion of the term of this patent subsequent to Aug. 13, 1991, has been disclaimed.

[22] Filed: Aug. 12, 1974

[21] Appl. No.: 496,887

Related U.S. Application Data

[63] Continuation-in-part of Ser. No. 330,676, Feb. 8, 1973, Pat. No. 3,829,099.

[52] U.S. Cl. ..... 273/131 AB

[51] Int. Cl.[2] ..... A63F 3/02

[58] Field of Search ..... 273/131

[56] References Cited

UNITED STATES PATENTS 3,829,099 8/1974 Lucero ..... 273/131 KC

*Primary Examiner*—Delbert B. Lowe

[57] ABSTRACT

The two sets of chess pieces being positioned on opposing ends of a chess board are each divided into readily identifiable half-sets. The half-sets are then moved over the chess board as separate entities by two, three or four players in accordance with predetermined rules.

1 Claim, 1 Drawing Figure

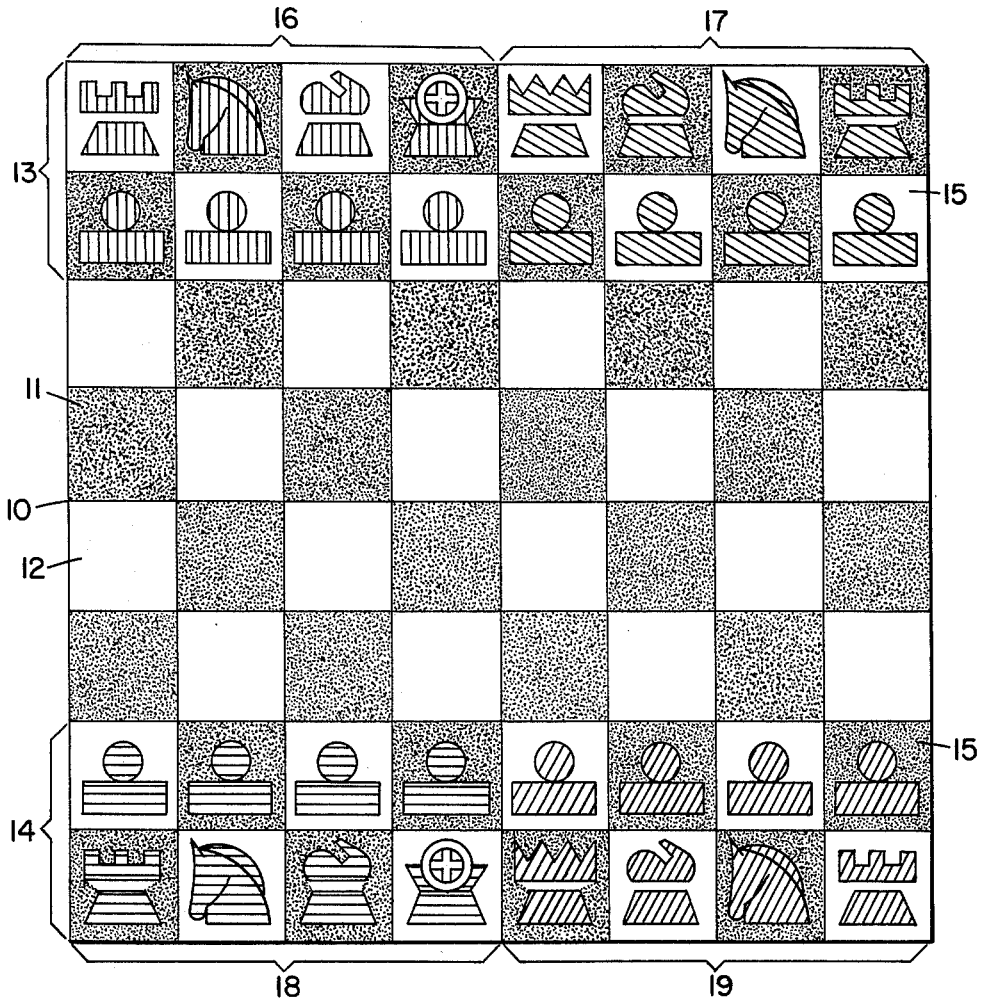
16
17
13
15
11
10
12
15
14
18
19

METHOD PROVIDING CHESS APPARATUS

RELATED APPLICATION

The present application is a continuation-in-part of the copending application Ser. No. 330,676 filed Feb. 8, 1973 by the same applicant and issued as U.S. Pat. No. 3,829,099 on Aug. 13, 1974.

The present invention relates to a game played on a game board, more particularly to playing a game of chess with two, three, or four players.

The game of chess has been played for centuries and has retained its popularity for this time. While considered by many to be a very fascinating and interesting game it calls for great mental effort when played well. Further, long study is generally required to attain any degree of proficiency in this game. The mental effort required to play the game well demands great concentration during playing of the game. The game of chess is therefore not considered to be particularly entertaining but is of considerable interest to those few persons who have devoted considerable time to learning to play the game.

On the other hand, the complexities and virtually unlimited combinations of moves and situations possible can sustain one's interest over long periods of time. In an effort to make the game more interesting various proposals have been made for playing the game of chess by more than two persons. However, such proposals have invariably increased the complexity of the game and have never met with any degree of popularity.

It is therefore the principal object of the present invention to provide an apparatus for playing a game using at least one modified set of chessmen.

It is another object of the present invention to make a chess game which incorporated all of the interest of a conventional chess game but which provides more entertainment.

The objects of the present invention are achieved and the disadvantages of the prior art as described above are eliminated by the present invention. The present invention essentially comprises providing a chess apparatus using at least one two-part team set of chessmen or chess pieces. Each half-set of a team-set of chessmen has a different visual indicia, such as color, thereon and each half-set or two half-sets may be controlled by one player. The two players having the half-sets of one team-set of chessmen may comprise a team and make their moves in accordance with certain rules in addition to the conventional rules of chess.

Other objects and advantages of the present invention will be apparent upon reference to the accompanying description when taken in conjunction with the following drawing, which is exemplary, wherein:

A top plan view of a chess board is down having sets of chessmen thereon with the chessmen being indicated by conventional symbols and lined for different colors.

Proceeding next to the drawing wherein like reference symbols indicate the same parts throughout a specific embodiment of the present invention will be described in detail As may be seen in the drawing, a conventional chess board is indicated generally at 10 and comprises alternating shaded squares 11 and clear squares 12 arranged to comprise the total of sixty-four squares. The coloring of the shaded and clear squares may be any desired, for example, the conventional red and black squares used on chess boards or any other combination of contrasting shading or colorings.

Positioned on one end of the board is a first set of chessmen 13 and on the opposite end of the board a second set of chessmen 14. Each set of chessmen is conventional and the individual pieces are positioned according to the rules of chess with the Pawns constituting a front row 15 and the other pieces positioned according to the symbols conventionally used therefor.

Each set of chessmen is divided in half to form the half-sets16,17 on one end of the board and the half-sets 18,19 at the other end of the board. The half-set 16 which contains the King is known as the King's men and the other half-set containing the Queen is known as the Queen's men. These two half-sets are considered as separate halves of one partnership or team of players.

Each of the half-sets 16–19 is provided with a different color to form in effect four separate readily identifiable entities or teams. The particular colors employed are immaterial but the colors should be contrasting and form a pleasing pattern when considered with the colors of the squares of the game board.

According to one method of playing each player controls a half-set of chessmen with the two players at each respective end of the board constituting a team and playing together according to a few rules which are superimposed upon the conventional rules for chess.

The teammates or players at an end of the board such as players 16,17 and the opposing team 18,19 are not allowed to consult on moves. Each partner must move in anticipation of his or her partner's move without any discussion. Should there by any advise or discussion by one partner to another the game is automatically forfeited to the opposing team.

Each team of two players makes two moves in succession which constitutes one turn. The King's men always make the first move in each turn. However, the team which makes the first move of the game is allowed only one move which is made by the King's men. Each player may move only those eight men under his or her command, with the following exception: A King in check may have the option of moving any of the Queen's men instead of his own. This constitutes a King's men move and the King is not required to break the check with this move. Also, a King may move Queen's Rook in order to Castle.

No one piece may be moved more than once in each turn. If a King in check moves one of the Queen's men that same man may not be moved again by the Queen's men player until the next turn.

Any player may exercise the option to pass and move none of his men except that only one pass per turn is allowed and that both players of a team may not pass in succession. If, for example, all of the Queen's men are lost, that team has lost its option to pass and the King's men player makes only one move per turn for the remainder of the game.

A King in check may not make a move that is also in check, even though the Queen's men could break that same check during the same turn. The king is only allowed to either remain in check, thus requiring the Queen's men to break the check, or to move out of check.

Should any Pawn reach the first row of the opposing team it may be converted into any piece of either king's men or Queen's men. For example, a Queen's Pawn reaching the first row of King's men can be converted into the Queen of the King's men or any other piece of the same team except for a second King.

As in the conventional game of chess, the game is ended when either team cannot move out or break a check in one turn.

The game may also be played by two players wherein each player controls two half-sets of a team-set. Where there are only two players each player has two moves to enable him to move each of his half-sets before the next player who then similarly has the opportunity to make two moves, i.e., one for each of his half-sets.

It is also possible for the game to be played by three players wherein one player controls two half-sets of a set of chessmen at one end of the board and two players at the other end of the board are his opponents each of whom controls one of the half-sets at that end of the chess board. The two players at one end of the chess board would play as partners. Where one player controls both half-sets of a set of chessmen at one end of the board it is preferred that the player move the King half-set first and then the Queen half-set second. This King half-set-Queen half-set sequence of moves is followed by each player throughout the duration of the game. As described above, when partners are playing it is preferable that the partners do not consult with each other during the course of play.

Thus it can be seen that the present invention has disclosed a two, three or four player chess game which is played by the conventional moves but is more entertaining since the partners on a team or individual players must try to anticipate the moves of the respective partners. Thus, the lower limit of skill is somewhat reduced and the human element is introduced which adds considerably to the excitement of the game. Since the game is played according to conventional rules no time is required to learn the rules of this particular game and anyone who has familiarity with the conventional rules of chess can sit down and play this game without any particular training or study.

It will be understood that this invention is susceptible to modification in order to adapt it to different usages and conditions, and accordingly, it is desired to comprehend such modifications within this invention as may fall within the scope of the appended claims.

What is claimed is:

1. A method of providing a chess game apparatus comprising making first and second half-sets, including at least one King half-set which comprises four Pawns, a Bishop, Knight and Rook and at least one Queen half-set which comprises four Pawns, a Bishop, Knight and Rook, distinguishable and combining the thus provided first and second half-sets to form one or more team-sets.

* * * * *